US011788355B2

(12) United States Patent
Ingraffia

(10) Patent No.: US 11,788,355 B2
(45) Date of Patent: Oct. 17, 2023

(54) LADDER CRAWLER

(71) Applicant: Chris Ingraffia, Chicago, IL (US)

(72) Inventor: Chris Ingraffia, Chicago, IL (US)

( * ) Notice: Subject to any disclaimer, the term of this patent is extended or adjusted under 35 U.S.C. 154(b) by 0 days.

(21) Appl. No.: 17/686,305

(22) Filed: Mar. 3, 2022

(65) Prior Publication Data

US 2023/0279725 A1 Sep. 7, 2023

(51) Int. Cl.
*E06C 7/14* (2006.01)

(52) U.S. Cl.
CPC ..... *E06C 7/14* (2013.01)

(58) Field of Classification Search
None
See application file for complete search history.

(56) References Cited

U.S. PATENT DOCUMENTS 2,883,134 A * 4/1959 O'Halloran ..... E06C 7/14 248/210
5,542,553 A * 8/1996 Penniman ..... E06C 7/14 182/129
6,024,192 A * 2/2000 Griffin ..... B25B 1/2484 248/210
7,967,264 B1 * 6/2011 Peterson ..... E06C 7/143 182/115
2005/0056485 A1 * 3/2005 Tarlow ..... E06C 7/14 182/129
2006/0249331 A1 * 11/2006 Meeker ..... E06C 7/14 182/165
2007/0163837 A1 * 7/2007 Dyer ..... E06C 7/14 182/129
2011/0079467 A1 * 4/2011 Mares ..... E06C 7/14 182/129
2012/0006620 A1 * 1/2012 Astor ..... E06C 1/28 83/13
2012/0187266 A1 * 7/2012 Schirmacher ..... E06C 7/14 248/238
2016/0024845 A1 * 1/2016 Coe ..... E06C 7/14 220/737

* cited by examiner

*Primary Examiner* — Steven M Marsh
(74) *Attorney, Agent, or Firm* — James D Palmatier; Applied Patent Services, PC

(57) ABSTRACT

The ladder crawler for use with a ladder comprises C-shaped ladder leg engagement having a support platform and a ladder rung engagement portion adapted to removably attach to a ladder leg. The C-shaped ladder leg engagement may comprise front rollers adapted to ride on the front side of a ladder leg and back rollers adapted to bear against the back side of a the ladder leg. The support platform is attached to the C-shaped ladder leg engagement in spaced relation to the ladder rungs. The rung engagement portion comprises a plurality of pawls disposed adjacent to an inside of the ladder leg. At least one of the plurality of pawls may be adapted to engage a ladder rung to hold the work platform adjacent to the rung when in a locked orientation.

8 Claims, 5 Drawing Sheets

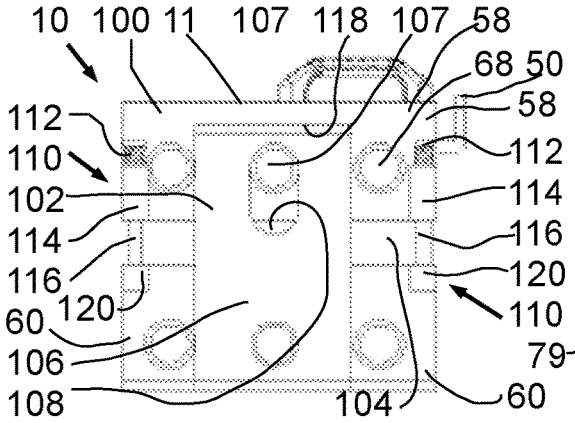
FIG. 8
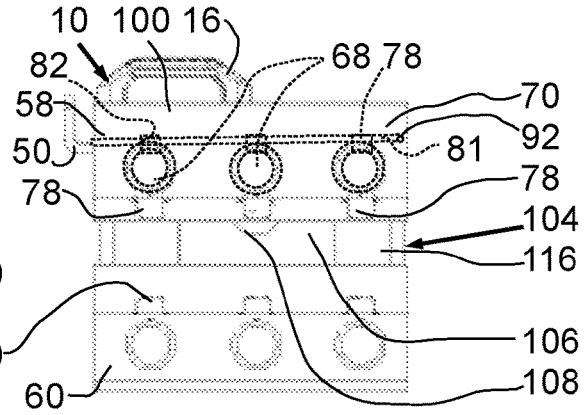
FIG.9
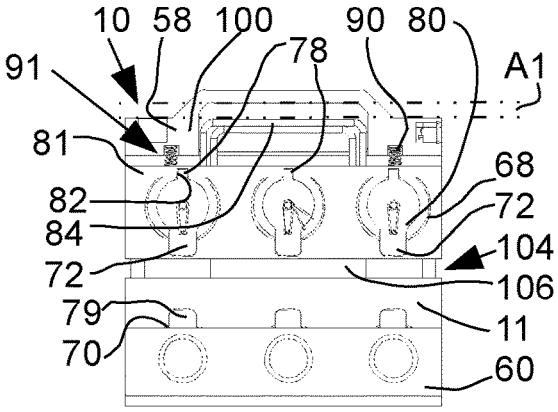
FIG. 10
FIG. 11
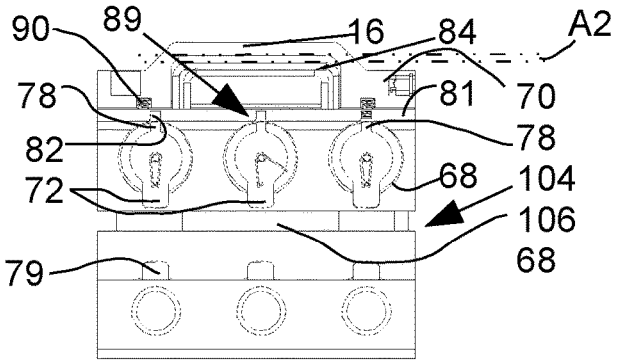
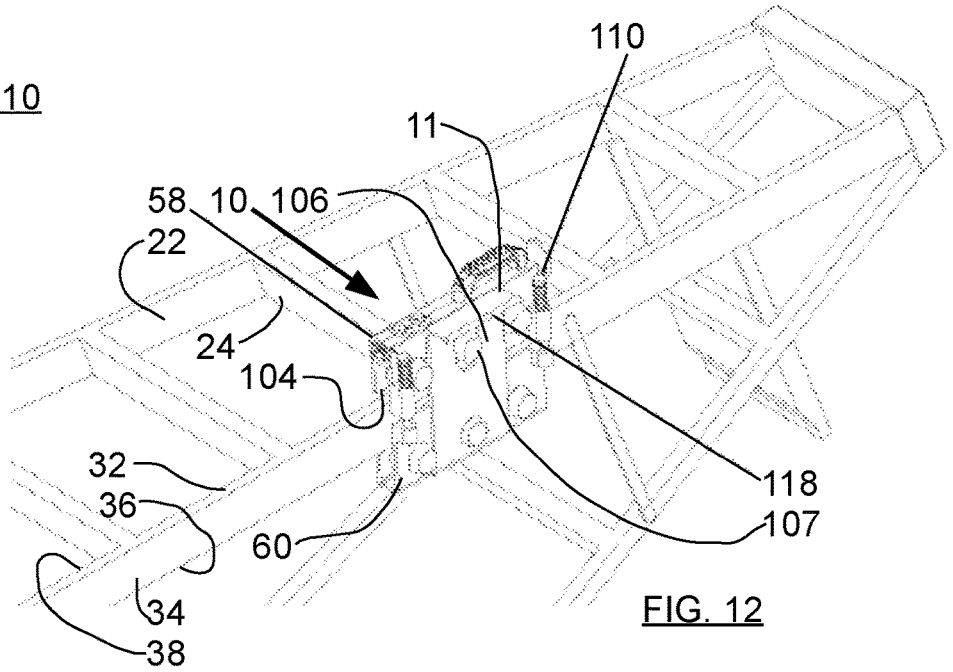
FIG. 12

LADDER CRAWLER

FIELD OF THE INVENTION

The present invention relates generally to a ladder crawler for use with a step ladder.

DESCRIPTION OF RELATED ART

Working on ladders, including stepladders, can be difficult and dangerous because the user needs ready or convenient access to tools and materials while on the ladder. Climbing up and down the ladder is tiring and dangerous to exchange tools or get materials. It is even more inconvenient, and dangerous, when users attempt to hold various tools and material while on the ladder. Namely, users must balance themselves on the ladder while attempting to hold, manipulate, or otherwise use the tools and materials.

While stepladders have a top platform, it does not provide much assistance with holding tools and material. The top platform is small and easily disturbed as the user works near the top of the ladder. Various devices have been designed to hold materials and tools within reach while the user is on the ladder. These devices such as trays or bucket hangers may obstruct the path up the ladder and clutter the area around the user making it dangerous for the user and anyone below. These devices also require the user carry the tools and materials up the ladder for placement on the support.

These prior art devices have failed to properly and efficiently address the problems with working on a stepladder while having tools and materials within reach. Specifically, raising tools and materials to a predefined height on the ladder. As such, there exists a need for a system and device that can act as a crawling work platform that can be used to incrementally raise materials and tools in a manner that does not require the user to climb up and down the ladder carrying loose tools and materials. The device should be secured to the ladder and move with the ladder while being adjustably positioned between the base of the ladder and the top.

There is a need for a device to help lift and support materials and tools on a ladder that does not interfere with the rung area. The device should not impede the user from traversing the ladder or working on the ladder. Therefore, it is desirable to provide a work support for use on a ladder that slides along a ladder leg to lock in position at a predetermined height.

BRIEF DESCRIPTION OF THE PRESENT INVENTION

The present invention is a ladder crawler adapted to attach to a ladder leg and slidably traverse along the ladder leg to a predetermined position is achieved and to lock onto the ladder leg to hold the platform in the desired place. The ladder crawler may engage ladder rungs by sprockets adapted to roll over the rungs as the ladder crawler traverses upward and resist rolling over the rung, using it as a stop, when the ladder crawler is in a desired position. The ladder crawler may comprise trolley having an extended platform, tool hook and electrical outlets. The trolley may be disposed on one of the front legs of a ladder.

The trolley may have a body disposed on the outside of the ladder leg. The body may comprise a top portion and a bottom portion. The top portion may comprise front rollers. a locking bar and an sprocket. The bottom portion may comprise back rollers, back pawls and a spring loaded attachment to the top portion. The front rollers may be axially disposed on the top portion of the body. The front rollers are adapted to engage a front surface of the ladder leg. The back rollers may be axially disposed on the bottom portion of the body and adapted to engage the back side of the ladder leg whereby the leg may be held between the front rollers and the back rollers. The spring loaded attachment may be adapted to connect the top portion to the bottom portion whereby the front rollers are disposed in spaced relation to the back rollers. The spring loaded attachment may be disposed adjacent to the outer side of the ladder leg. When mounted on the ladder leg, the spring loaded attachment is adapted to urge the top rollers to bear against the front of the ladder leg and the back rollers to bear against the back of the ladder leg.

The sprocket may be coaxially mounted with the top rollers. The sprocket may comprise a pawl and a locking tab. The sprocket may be attached to a respective roller axle but does not rotate with the roller. The locking tab may be disposed on the sprocket opposite the front pawl. The locking tab may be adapted to engage the locking bar in the locked position thereby holding pawl in a fixed position, generally perpendicular to ladder leg. When the locking bar is engaged to the locking tab, front pawl will resist rotating about the roller axis. Front pawl may be adapted to engage a ladder rung to hold trolley in place along ladder leg. Front pawl, held in place by locking tab, is adapted to prevent rung from passing through the rung gap. In this position the pawl engages the rung and holds the trolley in position on the ladder leg. The front roller is disposed between the sprocket and the spring loaded attachment. The return spring on the sprocket and top portion, may be adapted to urge sprocket to pivot about the front roller axis to dispose the pawl to a rung engagement position. The return spring allows sprocket to rotate about the front roller axis as ladder rung bears against rung as trolley traverses along ladder leg.

The front pawls may be adapted to engage the ladder leg on the inner side. Front pawls bear against ladder leg to hold ladder leg in contact with front rollers. In use, the ladder leg may be disposed between the front pawls and the spring loaded attachment whereby the front and back rollers bear against the top and bottom of the ladder leg respectively. The ladder leg may be between the top roller and the bottom roller and the front pawl and back pawl may be disposed on the inside of the ladder leg thereby holding the ladder leg in a C-shaped surround having a rung gap between the front pawl and back pawl. Back pawl is likewise spring loaded with back return spring on back pawl and back portion adapted to dispose back pawl generally perpendicular to leg as the trolley traverses along the ladder leg between the ladder leg foot and the ladder head.

The space between the front rollers and the back rollers may be a rung gap disposed between the front pawl the back pawl. Rung gap may be adapted to receive the ladder leg between a front roller and a back roller as the trolley is adapted to ladder leg.

A back pawl may be pivotally attached to back portion. The back pawl may be coaxial with a respective back roller. Locking pawl is diametrically opposed to front pawl. Return spring has a first end on the top portion and a second end on the sprocket to urge the locking pawl in a generally perpendicular, rung engagement orientation to the ladder leg. The return spring may be adapted to urge sprocket to pivot about the front roller axis to dispose the pawl to a rung engagement position. The return spring allows the pawl to rotate about the front roller axis as the rung traverses in the inside rung gap.

The locking bar may be adapted to move from a spring urged locked position and a user depressed release position. In the release position, the locking bar allows the front pawl to pivot about the roller axis. The front pawl may engage a ladder rung as trolley traverses along ladder leg. Ladder rung may urge front pawl and back pawl to rotate about a respective axis to allow the trolley to traverse on ladder leg. Return springs are adapted to urge front pawl and back pawl to a rung engagement position. In the locked position, the locking bar engages the locking tab to prevent rotation about the respective axis. In the locked position, the front pawl may bear against the ladder rung to hold trolley in position on the ladder leg. Trolley may be held on ladder leg at a position adjacent to the engaged ladder rung. User may engage locking bar to move to locking bar to release position whereby tab openings on locking bar are in spaced relation to locking tab and allow sprocket rotation about axis. The trolley may be adjustably positioned along the ladder leg by grasping the handle, engaging the locking bar to release sprocket.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 8 is an outside elevation view of the ladder crawler of FIG. 1.

FIG. 9 is an inside elevation view of the ladder crawler of FIG. 1.

FIG. 10 is an inside elevation view of the second embodiment of the ladder crawler with the cover removed and the sprockets unlocked.

FIG. 11 is an inside elevation view of the second embodiment of the ladder crawler with the cover removed and the sprockets locked.

FIG. 12 is a bottom perspective of the ladder crawler on a step ladder.

DETAILED DESCRIPTION OF THE PREFERRED EMBODIMENT

Figure 1:
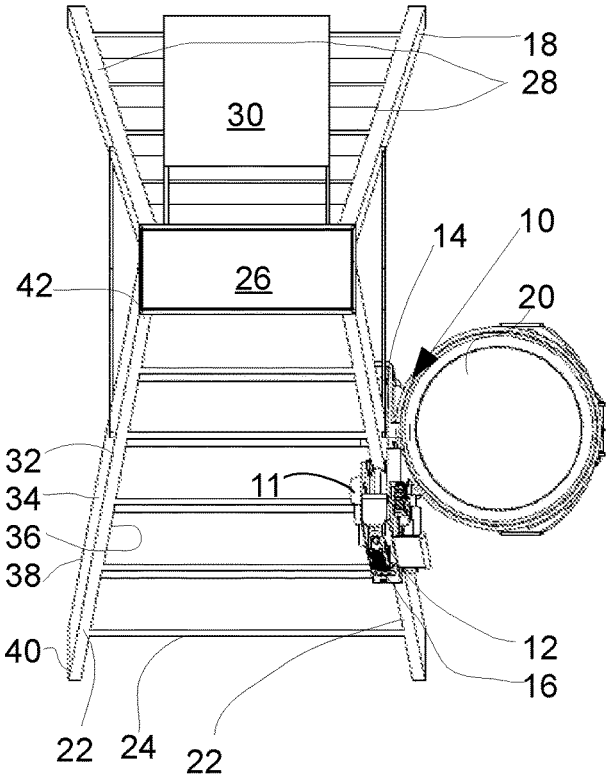
FIG. 1 is a top view of the ladder crawler on a step ladder in accordance with the present invention.

Referring to FIG. 1 the sliding ladder crawler 10 may comprise a trolley 11 having a bottom end 12, a top end 14 and a handle 16 mounted on ladder 18. Ladder 18 may comprise front legs 22, rungs 24 disposed between front legs 22, a ladder top 26, one or more back legs 28, and a ladder tray 30. Each of the front legs 22 may comprise a leg top side 32, a leg outside 34, a leg inside 36 and a leg back side 38. Front legs 22 may further comprise a ladder leg floor end 40 and a ladder leg top end 42. Trolley 11 may be supported on ladder 18 along one of the front legs 22.

Figure 2:
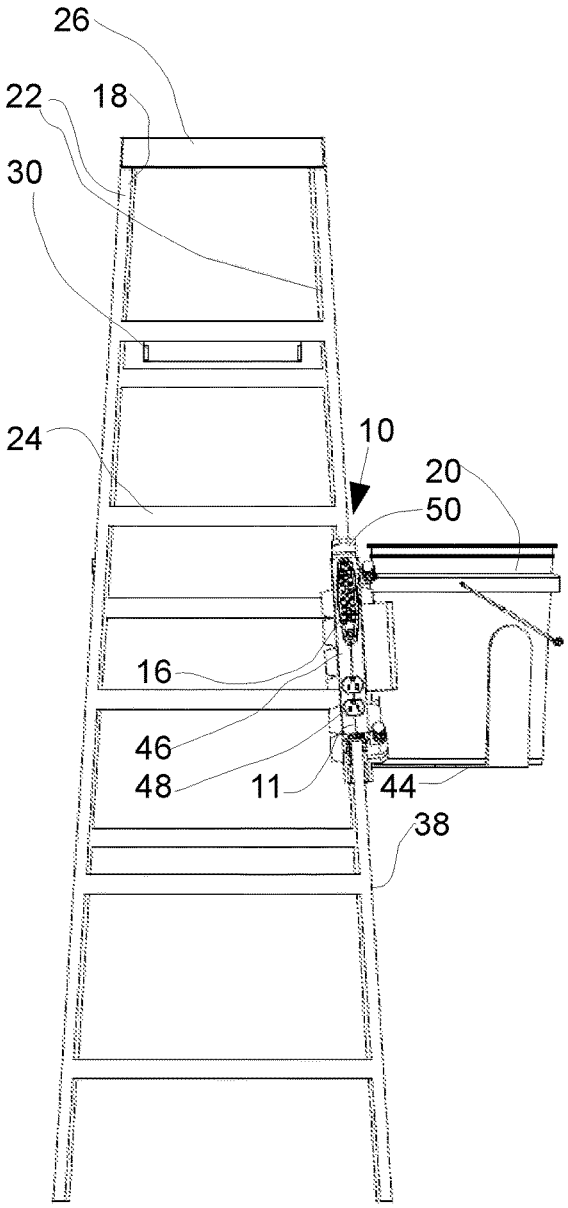
FIG. 2 is a front view thereof.
Figure 3:
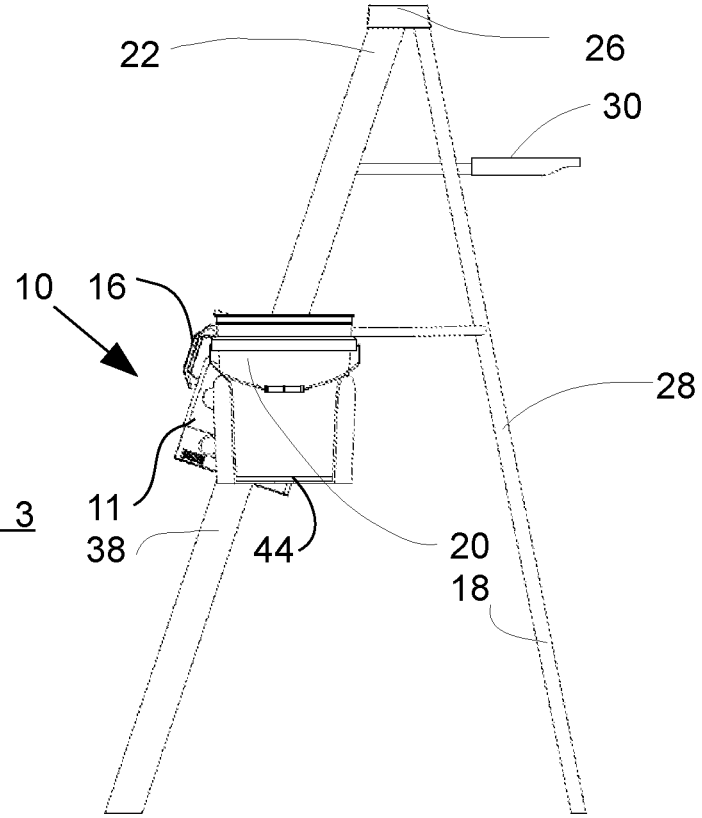
FIG. 3. is an outside view thereof.

Referring to FIGS. 2 and 3, ladder crawler 10 may sit on one front leg 22 along ladder leg outside 38 and spaced from the rungs 24 to provide un-obstructed access to the front of the ladder 18. The trolley 11 may further comprise a support platform 44. The support platform 44 adapted to support a bucket 20 or other tools and materials. Trolley 11 may further comprise a cover 46 and electrical outlets 48. Release handle 50 may be disposed on trolley top 14 for thumb access by user. Release handle 50 may be adjacent to handle 16.

Figure 4:
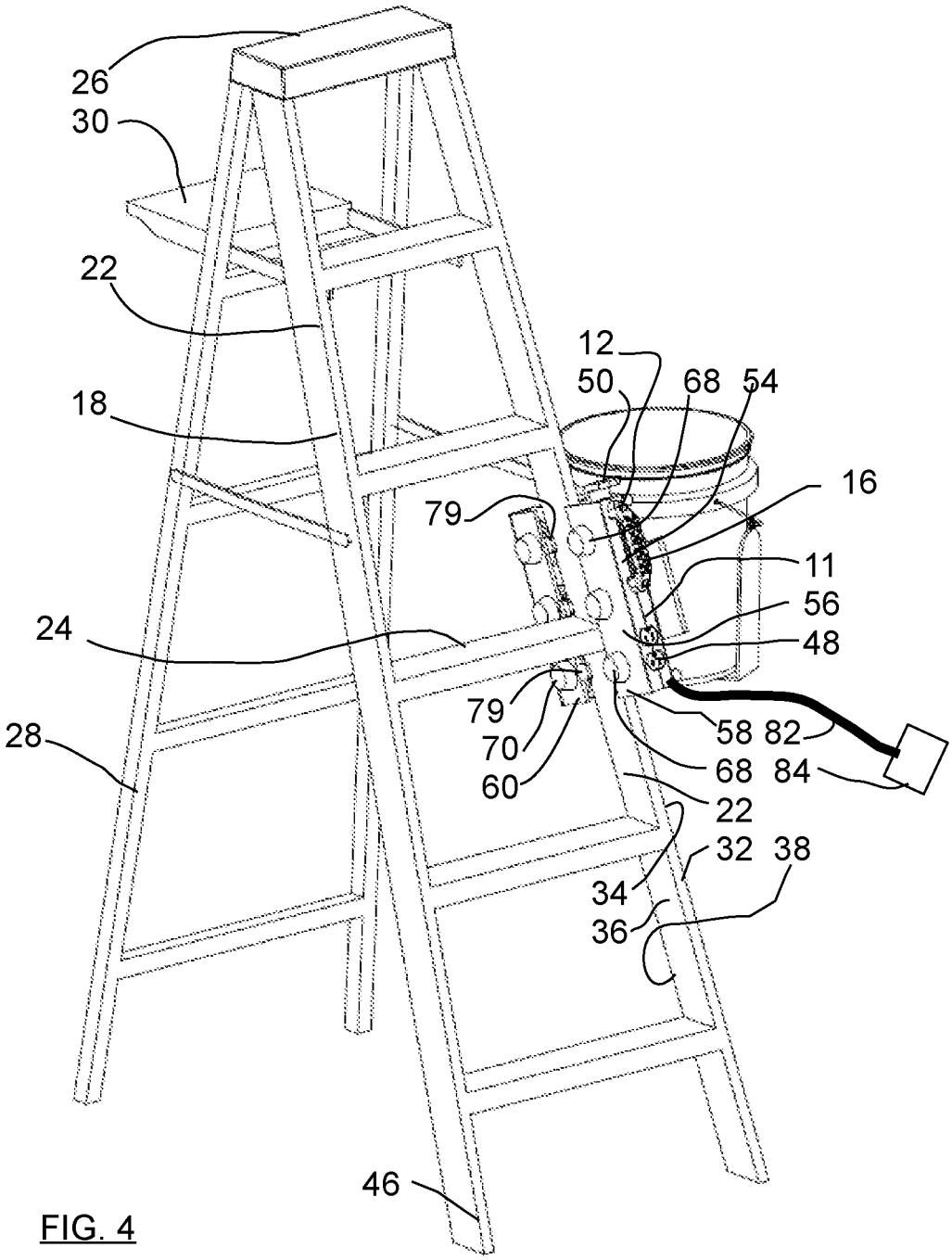
FIG. 4 is an inside perspective view thereof.

Referring to FIG. 4, trolley 11 may comprise a leg surround 56 comprising a front portion 58 and a back portion 60. The handle 16 may be on the front portion 58 extending away from ladder 18. Front roller 68 may be rotatably disposed on front portion 58 and adapted to bear against and traverse along ladder leg front edge 32 to support trolley 11 on ladder leg 22. Trolley 11 may further comprise an electrical cord 82 attached to outlets 48 and electrical plug 84 on electrical cord 82 for connecting to a wall outlet (not shown) to provide power to the trollyl 1. Back portion 60 may comprise back rollers 70 and back pawl 79. Back rollers 70 may be rotationally attached to back portion 60. Back rollers 70 may be adapted to bear against and roll along ladder leg back side 38. Back pawl 79 may be disposed on back portion 60 having a front end 81 extending from back portion towards top portion 58. Back pawl front end 81 may be disposed adjacent to or on ladder leg inside 36. When trolley 11 is mounted on ladder leg 22, ladder leg inside surface 36 is between back pawl 79 and outside surface 34.

Figure 5:
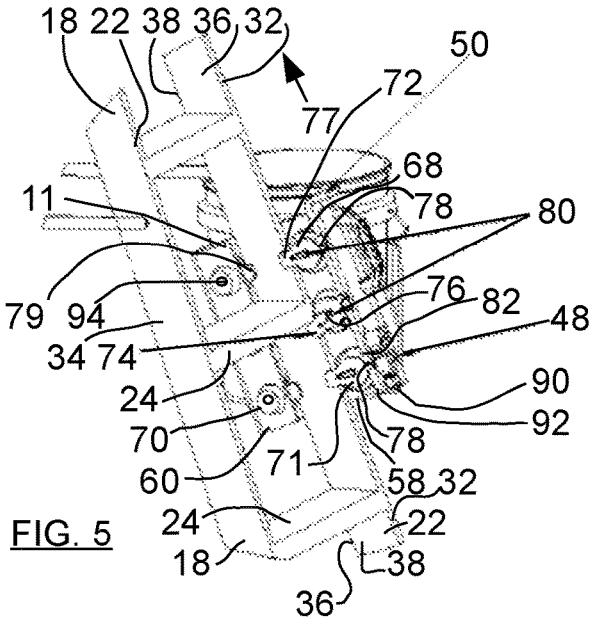
FIG. 5 is an enlarged view of the ladder crawler of FIG. 4 with the cover removed and the sprocket in the locked position.
Figure 6:
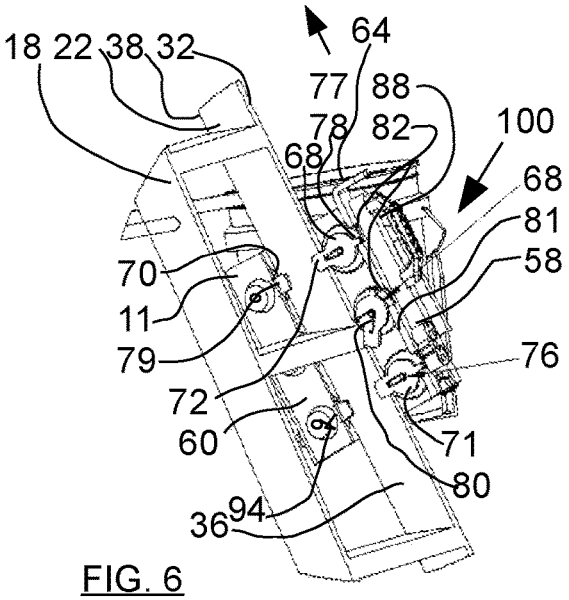
FIG. 6 is the enlarged view of the ladder crawler of FIG. 4 with the cover removed and the sprocket in the unlocked position rolling over a ladder rung.
Figure 7:
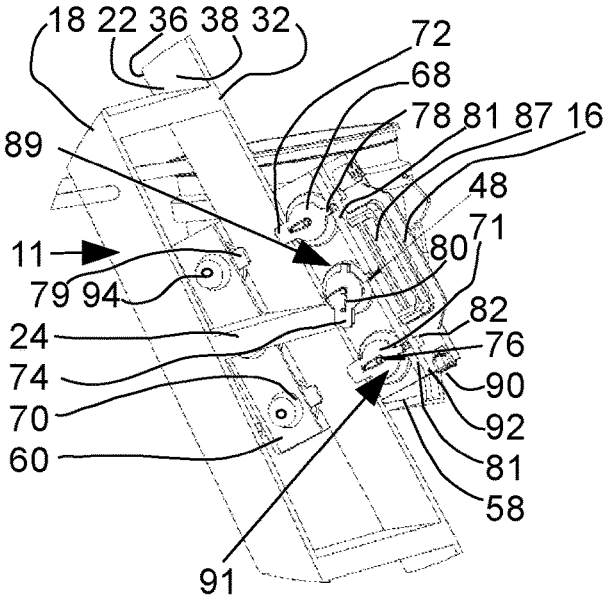
FIG. 7 is an inside perspective view of a second embodiment of the ladder crawler.

Referring to FIGS. 5 and 6, front rollers 68 may each further comprise a roller sprocket 71 on the front locking pawl 72. Sprocket 71 may be rotatably attached to the top portion 58, preferably on a respective roller axle 76, whereby front roller 68 is between sprocket 71 and top portion 58 on the respective roller axle 76. Locking tab 78 may be disposed on sprocket 71 extending from sprocket 71 generally opposite locking pawl 72. Locking pawl 72 may be disposed in a generally perpendicular orientation to front ladder leg side 32, adjacent to or bearing on ladder inside 36 and extending toward ladder leg back side 36. Locking pawl 72 may be adapted to engage ladder rung 24 as trolley 11 traverses along ladder leg 22. Front roller 68 and sprocket 71 may be rotatably attached to front portion 58 by roller axle 76. Sprocket 71 may rotate about roller axle 76. Front roller 68 may freewheel about roller axle 76. Front pawl 72 may be urged in a orientation generally perpendicular to ladder leg 22 by return spring 80 on front portion 58 and sprocket 71. Front pawl 72 may be urged to rotate about axle 76 by rung 24 passing between front portion 58 and back portion 60 as the trolley 11 traverses upward, generally indicated by the arrow 77, along front leg 22. Front pawl 72 may engage ladder rung 24 thereby urging sprocket 71 to rotate about roller axle 76 allowing step 24 to pass between front portion 58 and back portion 60. Rotation of sprocket 71 about roller axle 76 may cause return spring 80 to compress. Return spring 81 extends from top portion to sprocket 71 to urge sprocket in a generally perpendicular orientation to ladder leg 22.

Referring to FIG. 6, back portion 60 may further comprise a plurality of back pawls 79 rotatably disposed on back portion 60 and oriented in a generally perpendicular orientation to ladder leg 22. Back pawls 79 may be urged to a generally perpendicular orientation to ladder leg 22 by centering spring 94. Centering spring 94 may extend between back portion 60 and back pawl 79. Back roller 70 may be adapted to roll along ladder back side 38 having ladder leg 22 disposed between front roller 68 and back roller 70. It should be understood, the front pawls 72 and the back pawls 79 a bear against leg inside 36 to hold trolley 11 on front leg 22 by capturing leg 22 in a leg surround 56. Leg surround 56 comprises front pawls 72 and back pawls 79 adjacent to ladder leg inside 38, top portion adjacent to ladder leg top side 32 and ladder leg out side 34, and back portion 60 adjacent to ladder leg back side 36 and ladder leg out side 34.

Continuing to refer to FIGS. 5 and 6, locking bar 50 may comprise a thumb tab 64 and a lock body 81. Lock body 81 may further comprise a plurality of sprocket openings 82. Each of the plurality of sprocket opening 82 is disposed adjacent a respective locking tab 78. Each of the sprocket openings 82 may be adapted to receive a respective locking tab 78 therein when the locking body 81 is in the locked position. Locking body 81 may move from an unlocked position wherein each sprocket opening 82 may be spaced from a respective locking tab 78, to a locked position wherein each locking tab 78 may be disposed in a respective opening 82. Sprocket opening 82 may be a hole drilled in locking body 81 or a slot cut therein. When a locking tabs 78 is in a respective sprocket opening 82 front pawl 72 may be held in locked position 79 generally perpendicular to ladder edge 32 thereby not allowing a rung 24 to urge sprocket 71 about roller axle 76. Locking pawl 72 may bear against rung 24 to hold trolley 11 along ladder leg 22. It should be understood, in locked position having each locking tab 78 in a respective sprocket hole 82, the sprocket 71 may be prevented from rotating about axle 76. When locking bar 64 is in the locked position, ladder leg is captured between front pawl 72 and back pawl 79 on leg inside 36, front roller 68 on leg front edge 32, and back roller on leg back side 38. Locking tab may be adapted to extend into sprocket opening 82 when locking bar 64 is in the locked position. Locking tab 78 is spaced from locking bar 68 when locking bar 64 is in the unlocked position allowing front pawl 72 to rotate freely about roller axis 68. Locking bar 64 is moved from the locked position to the unlocked position by moving locking bar 64 to a spaced disposition with respect to locking tab 78.

Referring to FIGS. 7-12, an alternate locking arrangement is shown having a lock handle 87 disposed concentric with handle 16. Lock handle 87 may be attached to locking bar 81. Squeezing the lock handle 87 and the crawler handle 16 together may urge lock handle 87 and attached locking bar 81 away from sprocket 71 to an unlocked position 89. Lock handle 87 may be adapted to move locking bar 81 away from sprocket 71 to dislodge locking pawl 78 from sprocket opening 82. In this unlocked orientation 89, sprocket 71 may rotate about axle 76 to allow rung 24 to pass between front portion 58 and back portion 60. Locking bar 84 may be urged by locking spring 80 to a locked position 91 having lock tab 78 in sprocket opening 82. Upon release of the lock handle 84, locking spring 90 may urge locking bar 81 into the locked position 91 whereby the locking tab 78 is disposed in a respective sprocket opening 82. The front pawl 72 is held in position generally perpendicular to front leg 22 by locking tab 78 in sprocket opening 82 preventing front sprocket 68 from rotating about front axis 76. Locking handle 84 may alternatively pivot about locking pin 92 to move locking bar 81 from the unlocked position to the locked position.

Referring to FIGS. 8-12, the trolley 11—may comprise a C-shaped leg surround 100 comprising a front portion 58, a back portion 60, a closed back 102 and front ladder opening 104. Closed back 102 may comprise plate 106 attached to back portion 60. Spring tensioner 110 comprising a plurality of springs 112, each surrounding a threaded fastener 116 extending through a socket 114 to threadably engage weld nut 120. Turning the threaded fastener 116 causes the respective spring 112 to compress or decompress and traverse the front portion 58 with respect to the back portion 60. Spring tensioner 110 is adapted to separate front portion 58 from back portion 60 to install or remove trolley 11. The spring tensioner 110 is tightened to reduce the ladder leg gap 104 to a predetermined spacing between front portion 58 and back portion 60. The pawls 78, **78*a* retain the ladder leg 22 in the ladder gap 104. In the use position, the ladder leg is enclosed by the C-shaped leg surround 100 on four sides 32, 34, 36, 38. The ladder leg 22 is between the closed back plate 106 and front pawl 78*a*. Plate flange 118 may be oriented generally perpendicular to front portion 58. Kno2 and pawls 78, 78*a*. Ladder leg 22 is also between front portion 58 and back portion 60**.

Continuing to refer to FIGS. 8-12, knob 107 may be disposed on front portion 58. Knob 107 is slidingly disposed in slot 108 to guide movement of front portion 58 with respect to back portion 60 when flange 118 is held in place and handle 16 is lifted with respect to front portion 58, compressing springs 112 and moving back portion 60 away from front portion 58 thereby opening ladder gap 104 to remove or install ladder crawler from ladder 18.

The trolley 11 traverses the ladder leg 22 by moving the locking lever 81 to the unlock position 89, using the handle 16 traversing the trolley 11 up the ladder leg 22 to a desired elevated position with respect to one of the rungs 24. Release the locking lever 81 urges the locking pawl 78 into a respective opening 82 and allow the trolley 11 to travel downward to engage the nearest rung 24 with front pawl 72.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A ladder crawler for use on a ladder, the ladder comprising a front leg and a ladder rung, the front leg comprising a leg front side, a leg back side, a leg inside and a leg outside, the ladder rung on the front leg, the ladder crawler comprising:

a trolley, the trolley comprising a C-shaped leg surround and a support platform, the C-shaped leg surround comprising a front portion and a back portion, the front portion comprising a handle, a knob, a front roller and a locking bar, the handle on the front portion, the locking bar on the handle, the front roller comprising a roller axle and a sprocket, the roller axle on the front portion, the front roller on the roller axle, the sprocket comprising a front pawl and a lock tab, the sprocket on the roller axle in a generally concentric orientation with the front roller, the lock tab on the sprocket, the front pawl on the sprocket opposite the lock tab, the locking bar comprising a plurality of sprocket openings formed therein, the lock tab in one of the plurality of sprocket openings, the knob on the front portion, the back portion comprising a back roller and a plate, the plate comprising a slot, the plate on the back portion, the back roller on the back portion in spaced relation to the front roller, the knob in the slot, the back roller comprising a back pawl, a leg gap formed between the front roller and the back roller, the support platform on the trolley in spaced relation to the front roller.

2. The ladder crawler of claim 1, further comprising a return spring, the return spring on the roller axle and the sprocket.

3. The ladder crawler of claim 1, wherein the handle further comprises a locking lever, the locking lever on the locking bar.

4. The ladder crawler of claim 1 further comprising a spring tensioner on the back portion, the spring tensioner bearing on the front portion.

5. The ladder crawler of claim 4, wherein the spring tensioner further comprises a bolt, a spring and a weld nut, the weld nut on the back portion, the spring on the bolt, the bolt slidably on the front portion, the bolt threaded into the weld nut, the spring disposed between the bolt and the front portion.

6. A ladder crawler, the ladder crawler comprising:

a C-shaped leg surround and a support platform, the C-shaped leg surround comprising a front portion and a back portion, the support platform on the C-shaped leg surround, the front portion comprising a front pawl and a handle, the back portion comprising a back pawl and a plate, the front pawl on the front portion, the back pawl on the back portion, the plate on the back portion in spaced relation to the back pawl;

a knob on the front portion, the plate further comprising a slot, the knob in the slot whereby the plate is slidably attached to the front portion;

a front roller, the front roller on the top portion between the knob and the front pawl, the front roller comprising a roller axle, a sprocket and a return spring, the roller axle on the top portion, the front roller on the roller axle, the sprocket on the roller axle in a generally concentric orientation to the front roller, the front pawl on the sprocket, the return spring on the front portion and the sprocket;

a back roller, the back roller comprising a centering spring and a back pawl, the back roller on the back portion, the back roller spaced from the front roller forming a leg gap between the front roller and the back roller, the back pawl rotatably on the back portion, the back roller between the back pawl and the plate, the centering spring on the back pawl and the back portion;

a locking tab, the locking tab on the sprocket; and a locking bar, the locking bar on the front portion, the locking bar comprising a release lever and a sprocket opening, the locking tab in the sprocket opening, the release lever on the front portion, the release lever on the locking bar.

7. The ladder crawler of claim 4, further comprising a spring tensioner on the back portion, the spring tensioner bearing against the front portion.

8. A ladder crawler comprising:

a trolley, the trolley comprising a C-shaped leg surround and a support platform, the C-shaped leg surround comprising a front portion and a back portion, the support platform on the C-shaped leg surround, the front portion comprising a handle, a front roller, a front pawl, a knob and a locking bar, the handle on the front portion, the knob on the front portion, the locking bar comprising a release-lever and a sprocket opening, the locking bar on the front portion, the release lever on the locking bar, the front roller comprising a roller axle, a sprocket and a return spring, the roller axle on the front portion spaced from the handle, the sprocket on the roller axle, the front pawl on the sprocket, the return spring on the front pawl and the front portion, the back portion comprising a plurality of back rollers, a back pawl, a plate and a spring tensioner, the back pawl on the back portion, the back rollers on the back portion in spaced relation to the front rollers, the plate on the back portion, the plate comprising a slot, the knob in the slot, the spring tensioner on the back portion, the spring tensioner bearing against the front portion; and a locking tab, the locking tab on the sprocket the locking tab in the sprocket opening.

* * * * *